US009251771B1

(12) United States Patent
Hsu

(10) Patent No.: US 9,251,771 B1
(45) Date of Patent: Feb. 2, 2016

(54) CLAMPING SEAT OF ELBOW JOINT OF MUSIC INSTRUMENT STAND

(71) Applicant: Worldmax International Inc., Taichung (TW)

(72) Inventor: Jui-Hsin Hsu, Miaoli County (TW)

(73) Assignee: Worldmax International Inc., Taichung (TW)

( * ) Notice: Subject to any disclaimer, the term of this patent is extended or adjusted under 35 U.S.C. 154(b) by 0 days.

(21) Appl. No.: 14/590,965

(22) Filed: Jan. 6, 2015

(51) Int. Cl.
*G10D 13/02* (2006.01)
*G10G 5/00* (2006.01)

(52) U.S. Cl.
CPC ..... *G10G 5/00* (2013.01)

(58) Field of Classification Search
CPC ..... G10G 5/00
USPC ..... 84/421, 415; D6/682.5; D8/396
See application file for complete search history.

(56) References Cited

U.S. PATENT DOCUMENTS 6,346,665 B1 * 2/2002 Liao ..... 84/421
2012/0118126 A1 * 5/2012 Sato ..... 84/421

* cited by examiner

*Primary Examiner* — Jianchun Qin
(74) *Attorney, Agent, or Firm* — Leong C. Lei

(57) ABSTRACT

Disclosed is a clamping seat for mounting to a music instrument stand, including a stand bar and an elbow joint coupled to the stand bar. The elbow joint has two ends each forming a clamping seat that is coupled to a support bar to complete elbow jointing of a music instrument. The elbow joint includes an elongate body having a middle section that is sloped at an angle and two ends on which the clamping seats are formed in such a way as to be parallel to each other so as to form a clamping arrangement having two ends at different planes. The clamping seat is centrally recessed to form a spherical trough of which upper and lower edge portions forming V-shaped trough-edge openings opposing each other to cooperate with a retention plate opposite thereto to achieve clamping for both a spherical member and a straight member.

8 Claims, 5 Drawing Sheets

CLAMPING SEAT OF ELBOW JOINT OF MUSIC INSTRUMENT STAND

TECHNICAL FIELD OF THE INVENTION

The present invention generally relates to an improved clamping seat of an elbow joint of a music instrument, and more particularly to a device comprising an elbow joint having two ends that form clamping seats each of which is centrally recessed to form a spherical trough and has upper and lower edge portions above and below the spherical trough and each formed with a V-shaped trough-edge opening by thinning the edge portion, each clamping seat being coupled to a retention plate that is inwardly recessed in a similar way for enclosing and holding therein an object so that the clamping seat is applicable to clamping a spherical member, a tube, or a bar to achieve a practical advantage of locking and mounting a music instrument.

DESCRIPTION OF THE PRIOR ART

A common music instrument combination is generally composed of various drums of different sizes in combination with special sound effect instruments, which through properly assembling, make up of a complete set of music instrument combination. Assembling the various music instruments together to form the music instrument combination is generally done with various instrument stands with aid of a number of elbow joints to have the music instruments to be combined together in an organized manner on the same plane or on different planes, allowing for percussion or hand touch that operate the instruments in an easy manner. Conventional elbow joint clamping seats or elbow joint connectors that are commonly used in combining music instruments are generally of various designs and arrangements. Taiwan Patent Publication No. 387511 proposes a joint structure having variable joint angle, which comprises, for making up an elbow joint, preformed vertical bar seat and horizontal bar seat that are combined together, through mutually mating toothed faces, to form a frame, allowing a stand or a bar to be mounted thereto in a variable manner with the elbow-jointing angle being adjustable, so as to realize adjustment of the position of the music instrument mounted thereto. Such an arrangement is a design based on inward-recessed configuration of a straight tube surface and is suitable for extension by means of large or long bars or tubes, but is not fit for assembling a mounting frame having a spherical end for angle adjustable joint. To cope with such a problem, Taiwan Utility Model M349535 suggests a multiple purpose clamping seat of drums, in which the clamping seat is designed in such a way that a spherical or V-shaped fixing trough structure having a specific spherical trough shape is formed through recessing to allow for jointing, fixing, and using various tubes, bars, and rods having specially-shaped spherical ends. Such a clamping seat is generally provided for drums and instruments attached to the drums. However, in an actual use of a music instrument combination and to suit the needs of a user, changing relative position through rotation and displacement is necessary. The single clamping slot design of the known device imposes constraints to an actual positional arrangement of the music instruments, the stands, and the jointing devices, causing inconvenience of actual uses of the instruments. The key issue is generally concerned about the clamping seat provided in the known device, which has a fixed clamping slot so that it cannot be used in a universal manner to clamp different tubular or spherical parts of a mounting stand. It is thus desired to provide a clamping seat that is fit to and applicable to various different clamping parts in the form of sphere, frame, and tube in order to overcome the problem of inconvenience of clamping occurring the conventional fixed clamping slot.

SUMMARY OF THE INVENTION

In view of the previously discussed shortcomings and issues of the conventional clamping seat structures for elbow joint connection of music instruments, for the purpose of easy use of assembling, operation, and control and secured safety of jointing, the present invention aims to provide an improved clamping seat of an elbow joint mounted to a music instrument stand, where an elbow joint has two ends each forming a clamping seat that has a recessed clamping trough surface formed as a centrally recessed spherical trough and upper and lower edge portions being thinned in such a way to form a V-shaped trough-edge notch having straight and inclined faces for clamping and assembling various bars, tubes, and spherical members thereby overcoming the inconvenience of use of the conventional clamping devices.

The present invention provides a clamping seat that is mounted to a music instrument stand through elbow jointing, comprising a stand bar for supporting a music instrument, an elbow joint mounted to the stand bar for coupling the music instrument, and clamping seats respectively arranged at opposite ends and corresponding retention plates for locking purposes, which collectively form a mounting structure coupled to the stand, characterized in that the clamping seats that are respectively arranged at the opposite ends of the elbow joint are each formed with a clamping cavity that is centrally recessed to form a spherical trough and upper and lower edge portions of each of the seats is provided with a V-shaped trough-edge opening for clamping purpose and comprising inclined straight faces to selectively clamp a straight tube, a bar, or a spherical member so as to ensure easy operation and locking safety in mounting the music instrument.

The purpose of the present invention is that an elbow joint is formed in such a way that two ends thereof each comprise a clamping seat having a clamping cavity that is formed as a centrally-recessed spherical trough and upper and lower edge portions above and below the cavity of the clamping seat are formed as V-shaped trough-edge openings having straight faces and symmetric to each other in top and bottom sides thereby providing a structure of clamping seat that can clamp both a spherical member and a straight tube and bar, whereby clamping can be achieved in any desired way in mounting music instruments so as to achieve easy assembling and safe and stable clamping.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
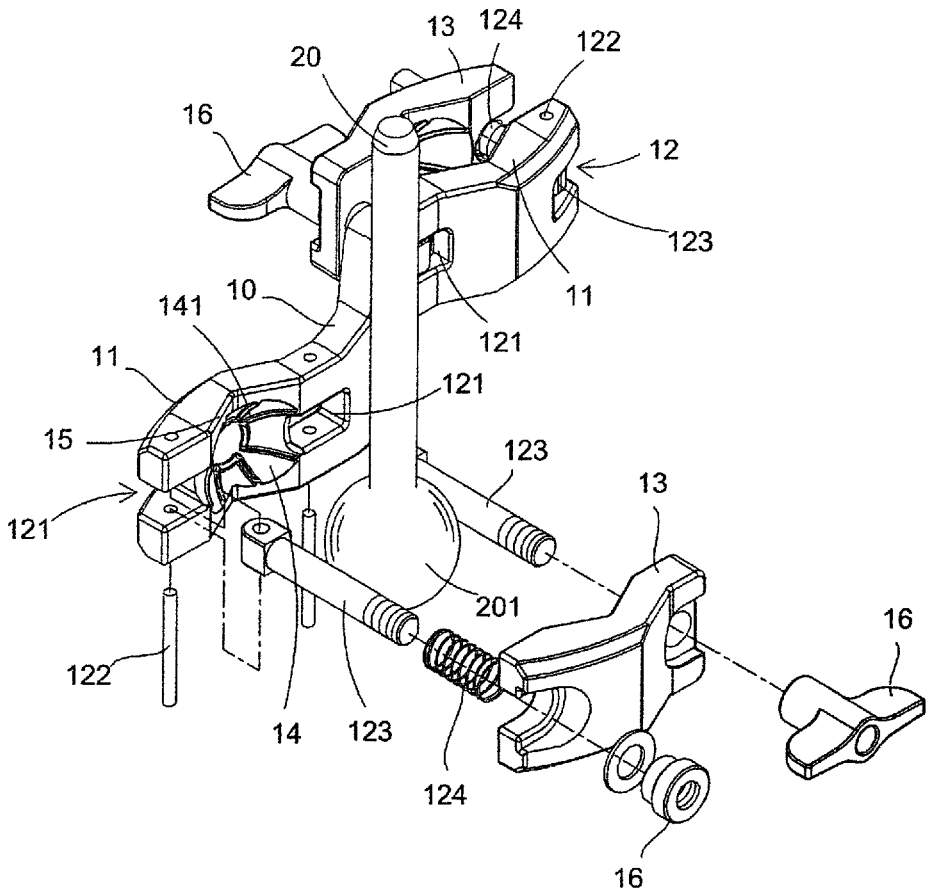
FIG. 1 is an exploded view of an elbow joint according to the present invention, in a condition of being assembled.
Figure 2:
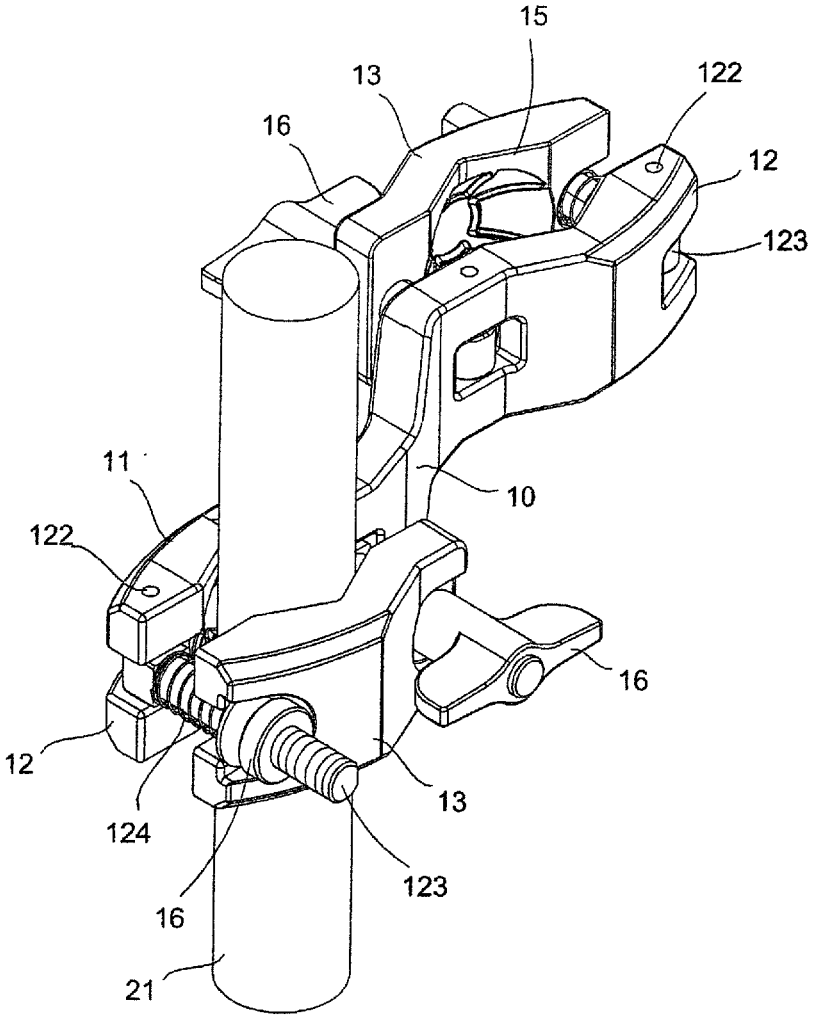
FIG. 2 is a perspective view showing the elbow joint of the present invention in an assembled condition.
Figure 3:
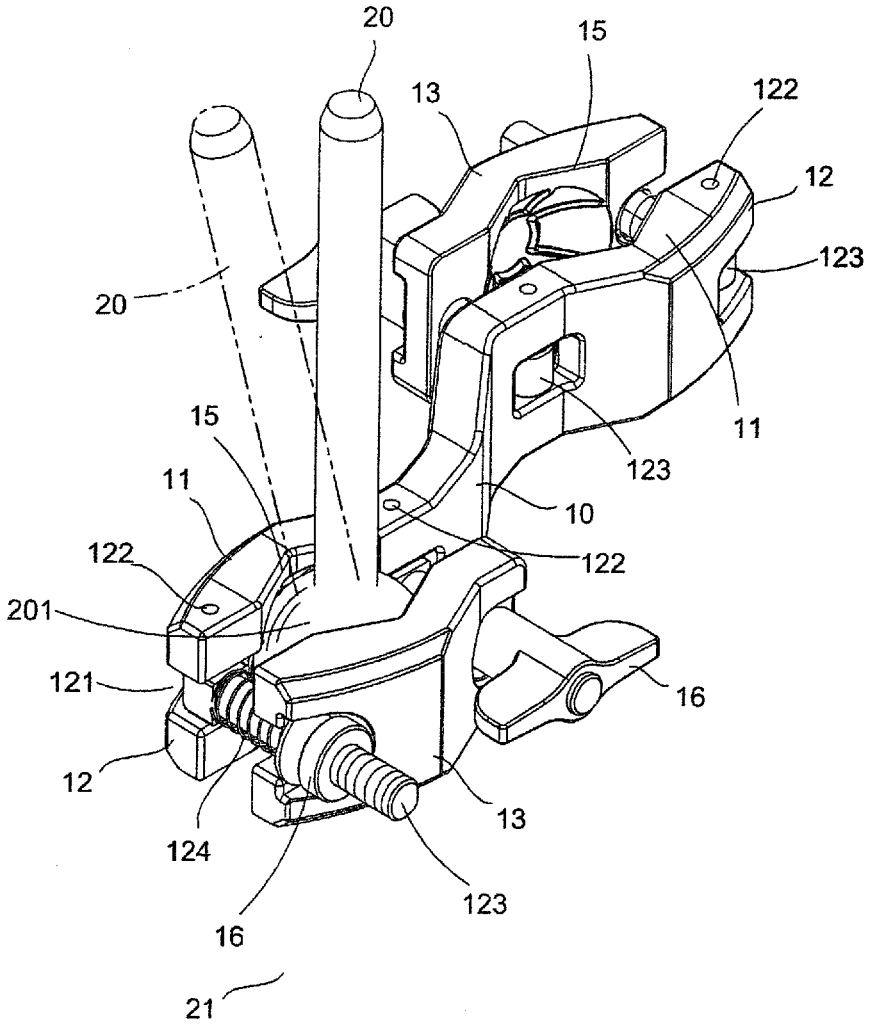
FIG. 3 is a perspective view of the elbow joint of the present invention in the assembled condition, illustrating an adjustment operation thereof.
Figure 4:
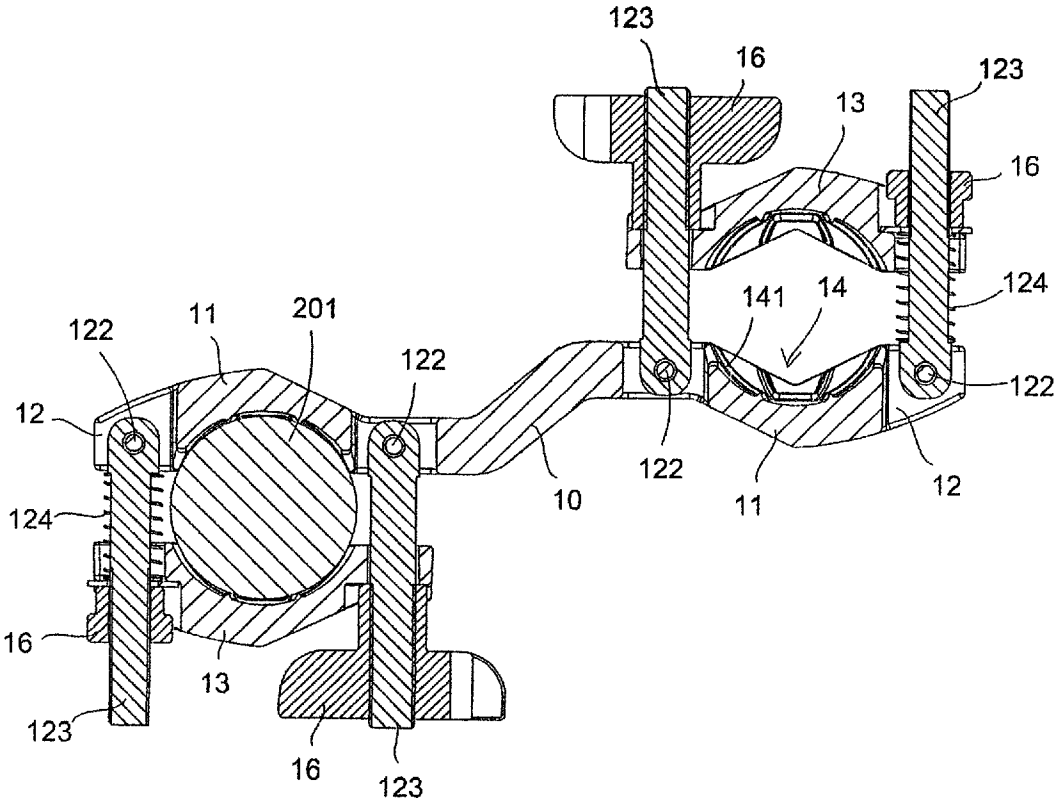
FIG. 4 is a cross-sectional view demonstrating the elbow joint of the present invention is used to clamp different objects.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides an elbow joint arrangement of a music instrument stand. As shown in FIGS. 1-5, the elbow joint arrangement comprises an elbow joint (10) that joints instrument support frames in an elbow-like manner. The elbow joint (10) is generally arranged in the form of an elongate plate for the purposes of satisfying the needs of practical uses. For easy assembling and jointing to achieve such an elbow like connection, a middle section of the elbow joint (10) is set in the form of an inclined plate having two opposite ends that each form a clamping seat (11) that has a side recessed to form a curved cavity for clamping an object. The clamping seats (11) of the two ends of the elbow joint are generally composed of plates that are substantially parallel but shifted sideway from each other to achieve an advantage that the objects that are clamped on the two ends are held in position in a mutually and sideways shifted manner so that the objects clamped on the two ends do not interfere with each other and interfere with assembling thereof to the elbow joint. The clamping seats (11) each have two edge portions on opposite sides of the curved cavity and respectively formed with pivoting seats (12) that comprise openings (121) formed therein to respectively receive and hold pivotally-connected bars (123) therein in a rotatable manner with fixing pins (122) extending therethrough to couple a retention plate (13), which is generally configured in a form symmetric to the clamping seat (11) and is secured in position by the pivotally-connected bars (123) extending through opposite edge portions thereof to thereby form a completely locking structure. The retention plate (13), which is configured similar to the clamping seat (11), comprises a cavity formed by inwardly recessing a side thereof to be generally similar to and symmetric to that of the clamping seat (11). The cavities, which are generally arranged similar to and symmetric to each other, are each inwardly recessed in a middle thereof to form a spherical trough (14) and also provided, on a surface thereof, with a roughened face by means of pre-formed embossing or arranged ribs, or alternatively, with equally spaced and arranged recessed grooves (141), so as to form a surface layer carrying properly arranged corrugated patterns to prevent slipping occurring in a locked condition with smoothness of surfaces in contact with each other. In each of upper and lower edge portions above and blow the spherical trough (14), an inwardly recessed V-shaped trough-edge opening (15), similar to a regular V-shaped clamping trough, is formed in the middle of the edge portion by arranging, in inwardly recessed manner, two inclined straight faces that extend from opposite edges of the cavity into the middle to correspond to the configuration of the cavity. For the purposes of safety and stability of clamping, to prevent excessive concentration of shearing force occurring in clamping due to excessively thinning of the edge portions, which may result in an application of a shearing force similar to that of a shearing operation conducted with scissors so as to cause damage of surfaces of a object or a bar clamped thereby, the straight edge is preferably provided with a width of at least 1 mm at the thinnest portion of the entire edge surface to achieve safe and stable contact engagement in clamping. The pivoting seats (12) at the side edge portions of the clamping seat (11) are each made in the form of an opening to receive and hold, in a rotatable manner, the pivotally-connected bar (123) that comprises the fixing pin (122) extending therethrough to be coupled to the edge portion of the retention plate (13). To ensure secured locking, one of the pivotally-connected bars (123) that are respectively attached to the edge portions is provided, in a middle section thereof, with an elastic element (124) encompassing therearound in order to provide a spring pushing force after being coupled for preventing undesired loosening of the locking. As such, a clamping seat for elbow joint is completed with these components properly assembled.

Figure 5:
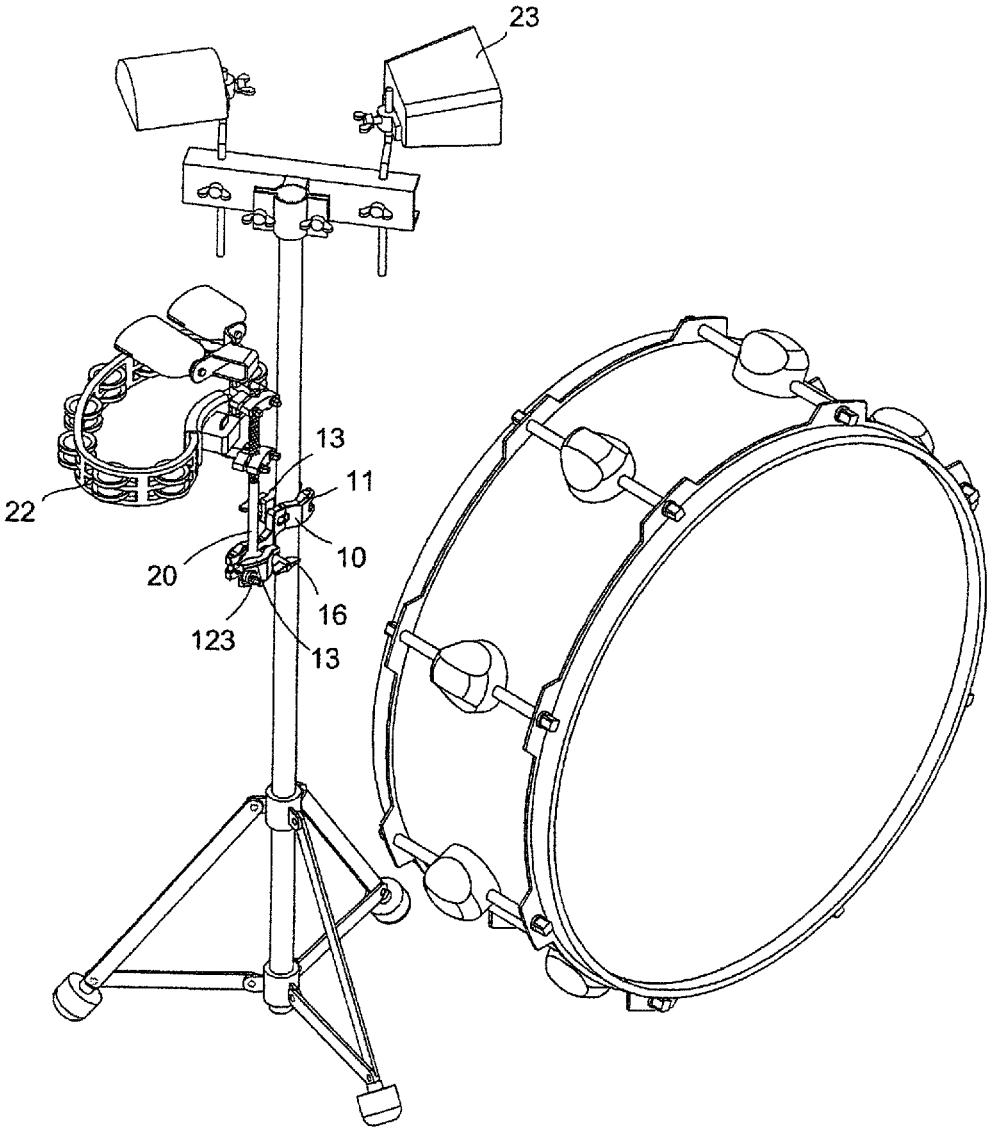
FIG. 5 is a perspective view illustrating a use of the present invention in mounting and supporting music instruments.

The design feature of the clamping seat structure of an elbow joint according to the present invention is as follows. The inwardly recessed curved cavities of the clamping seats (11) formed at opposite ends of the elbow joint (10) are arranged as curved locking faces in the form of centrally recessed spherical troughs (14) to allow for easy insertion and coupling of a connection support bar (20) that comprises a spherical member (201) having a spherical end. Thanks to positive enclosing achieved with the curved surface of the spherical trough (14), securely holding and retaining can be achieved with the retention plate (13) being properly set and coupled. The arrangement of the inclined and recessed V-shaped trough-edge openings (15) on the upper and lower edge portions of the spherical trough (14) allows for a regular straight (tubular) bar (21) to extend therethrough so as to achieve multiple point locking with the V-shaped opening, whereby the clamping seat (11) features uses of clamping and fixing both a spherical member (201) and a straight (tubular) bar (21). Thus, after the assembling of the elbow joint (10), the recessed configuration of the clamping seat (11) is suitable for achieving any desired locking and is particularly applicable to easy and convenient assembling with stands and support frames to be used in combination with music instruments, such as small-sized instruments, for example tambourine (22), cymbals or metal barrel (23), for easy position change and replacement. For example, as shown in FIG. 5, to change some of the music instruments illustrated therein, there is completely no need to disassemble and remove the elbow joint (10) and it only needs to release the fastening nuts (16) that secure the pivotally-connected bars (123) of the clamping seat (11) to allow the support bar (20) or stand bar (21) carrying the instrument to be changed to be removed and the music instrument can be detached for replacement. The entire operation of removing and assembling is easy and locking can be easily achieved to suit the need of safe use. Such a practical advantage of easy removing and assembling is an innovated structural design in products of this kind.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A clamping device for mounting to a music instrument stand comprising a stand bar for supporting a music instrument, the clamping device comprising an elbow joint mountable to the stand bar for coupling the music instrument to the stand bar, the elbow joint having opposite ends comprising clamping seats mounted thereto respectively and comprising retention plates, which are respectively coupled to the clamping seats through pivotally-connected bars attached to the clamping seats, wherein the clamping seats are each formed with a clamping cavity that is formed by recessing a central portion of a surface of the clamping seat to form a spherical trough located between upper and lower edge portions of the clamping seat, adapted to receive and securely hold, in combination with the retention plates, a spherical object therein and wherein the upper and lower edge portions of each of the clamping seats is provided with a V-shaped trough-edge opening in the form of a V-shaped notch comprising inclined straight faces that are inclined inwardly with respect to the surface of the clamping seat, the V-shaped notches of the upper and lower edge portions being substantially aligned with each other and adapted to selectively receive and clamp, in combination with the retention plate, a straight member therein;

wherein the clamping seats of the two ends of the elbow joint are identical to each other so that the two clamping seats are usable interchangeably.

2. The clamping device according to claim 1, wherein the spherical trough has a curved surface that is arranged in the form of a roughened surface.

3. The clamping device according to claim 2, wherein the roughened surface comprises embossing or raised ribs.

4. The clamping device according to claim 1, wherein the spherical trough has a curved surface in which equally spaced grooves are formed.

5. The clamping device according to claim 1, wherein the V-shaped trough-edge opening has an edge face that has a thinnest width greater than 1 mm.

6. The clamping device according to claim 1, wherein the elbow joint has a middle section that is curved to show an inclined arrangement such that the clamping seats that are mounted to the opposite ends of the elbow joint are shifted away from each other.

7. The clamping device according to claim 6, wherein the surfaces of the clamping seats are substantially parallel to each other.

8. The clamping device according to claim 1, wherein the pivotally-connected bars are respectively attached to opposite edge portions of each of the clamping seat, at least one of the pivotally-connected bars having a middle section over which an elastic element is fit to be located between the clamping seat and the retention plate.

* * * * *